United States Patent [19]

Parish

[11] Patent Number: 4,766,837

[45] Date of Patent: Aug. 30, 1988

[54] RECOVERABLE SEA ANCHOR

[75] Inventor: James M. Parish, Wadsworth, Ohio

[73] Assignee: The B. F. Goodrich Company, Akron, Ohio

[21] Appl. No.: 39,882

[22] Filed: Apr. 20, 1987

[51] Int. Cl.[4] ..... B63B 21/48

[52] U.S. Cl. ..... 114/311

[58] Field of Search ..... 114/297, 298, 299, 311

[56] References Cited

U.S. PATENT DOCUMENTS

| | | | |
|---|---|---|---|
| 130,503 | 8/1872 | Ingersoll | 114/311 |
| 2,490,460 | 12/1949 | McAvoy | 114/299 X |
| 2,536,682 | 1/1951 | Frieder et al. | 114/317 |
| 3,059,607 | 10/1962 | Wheeler | 114/298 |
| 3,397,665 | 8/1968 | Lindly | 114/298 |

*Primary Examiner*—Sherman D. Basinger

*Attorney, Agent, or Firm*—Joseph Januszkiewicz

[57] ABSTRACT

A recoverable sea anchor for a vessel wherein the anchor is made from a flexible sheet material with a periphery and a center. A plurality of lines interconnect a plurality of spaced points around such periphery to a ring which in turn is connected via a releasable connecting means to a swivel. A mooring line is then used to connect such swivel to the vessel. The releasable connecting means is operative to release the connection between the swivel and the ring in response to a predetermined load to put into play a disabling line, in a slack inoperative condition which then interconnects the swivel and the center of the chute or another portion of the chute to disable or collapse the concave chute. A modification of the sea anchor is to make it frusto conical or tubular in shape.

20 Claims, 6 Drawing Sheets

FIG. 9
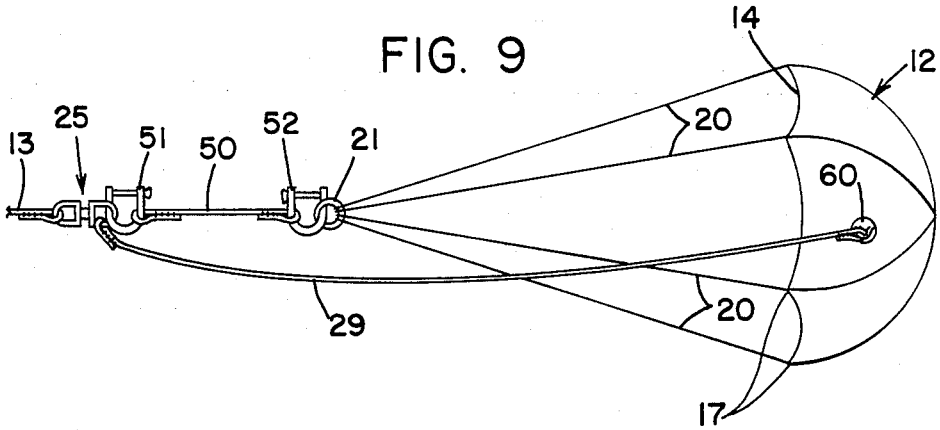
FIG. 10
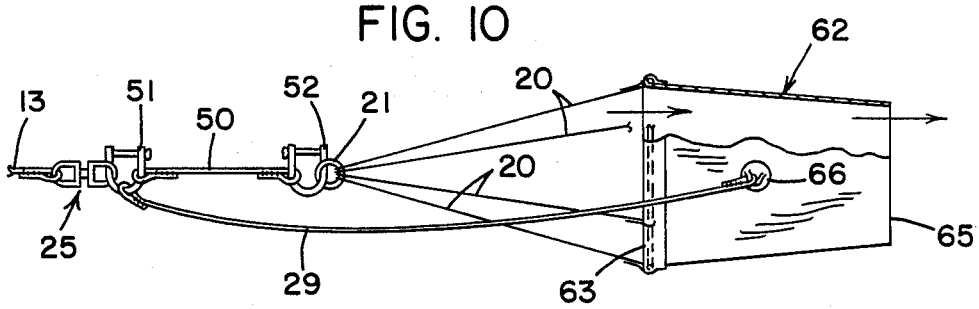
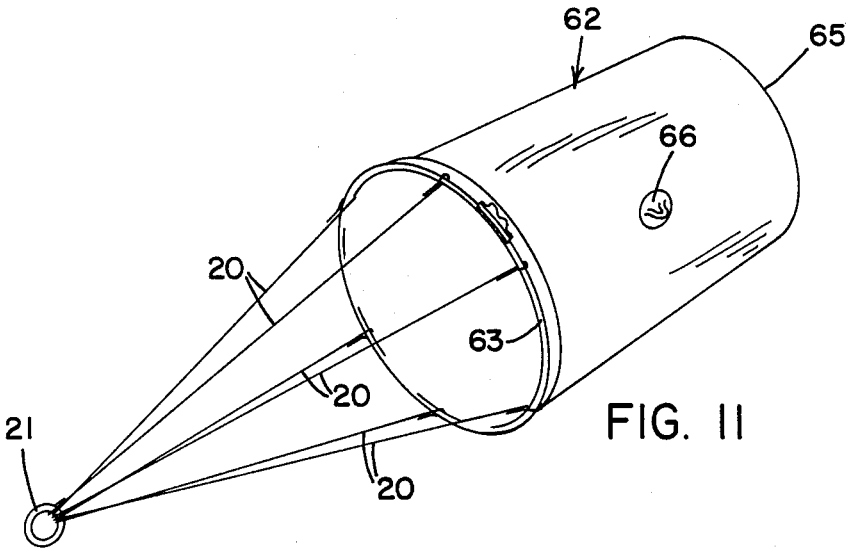
FIG. 11

RECOVERABLE SEA ANCHOR

FIELD OF THE INVENTION

This invention relates to sea anchors and more particularly to a new and improved sea anchor for use on a deployable raft typically smaller vessels for stabilizing a raft in rough waters and winds.

BACKGROUND OF THE INVENTION

Sea anchors as conventionally known is a device or instrument that is attached to a ship or other vessel by a cable and that being cast overboard lays hold of the earth by a fluke or hook and thus holds the vessel in a particular place or desired location. Sea anchors have been modified for use as devices for assisting in reducing undesired drifting in rough waters and to otherwise stabilize a small vessel such as a raft's motion. As hereinafter referred to, sea anchors or anchors refer to such modified forms of anchors. Such sea anchors utilize a flexible sheet that has spaced peripheral portions connected by ropes to a common mooring line from a raft to define a concavity such as a parachute, chute or an opened umbrella when deployed in water. Such concavity may be considered cup-shaped or saucer shaped. The mooring line's connection to the raft is generally via a loop patch or to multiple points on the raft which could in turn also be connected to the bottom of such rafts. In severe sea conditions, the loads exerted on the sea anchor can break the sea anchor line or tear the attachment points from the raft which could cause major damage to the raft resulting in raft flooding and possible loss of inflation chambers.

One alternative to this is to detach or release the anchor's connection to the raft to eliminate the excessive forces which would otherwise subject the raft to tears. A further alternative to releasing an anchor is to pull the anchor in and thence to deploy it when conditions permit. 0f particular difficulty in retrieving or pulling in anchors is that this must be done under abnormal weather conditions which make such retrieving dangerous. It is an object of this invention to provide means for automatically nullifying the effect of an anchor and its function on the occurrence of adverse forces or conditions. Such automatic means may be made re-settable upon termination of the adverse forces and the sea anchor can be redeployed. The present invention thus prevents the raft from tearing or being damaged by collapsing the sea anchor before loads become greater than the designed loads. The sea anchor of the present invention even in the collapsed condition will continue to prevent drift even in the collapsed position, however such sea anchor will be acting less efficiently, but loads will be less. Such action is a better alternative to the need or requirement of pulling the sea anchor out of the water under adverse conditions. Of particular importance is that such redeployable sea anchor can be made from standard hardware which will not require any maintenance.

These and other objects and advantages will appear more fully in the following detailed description when considered in connection with the accompanying drawings.

SUMMARY OF THE INVENTION

A recoverable sea anchor for a vessel or raft having a mooring line connected to the sea anchor via a swivel and a releasable connecting means. The sea anchor when deployed assumes a concave chute shape defining a plurality of spaced points around its periphery that are connected via a plurality of lines to a ring which in turn is connected to the releasable connecting means. The releasable connecting means is operative to release the connection between the swivel and the sea anchor in response to a predetermined load after which a disabling line in a slack condition interconnects the swivel and either the center of the concave chute or another portion of the chute and operates to disable or collapse the chute or sea anchor allowing retrieving of the sea anchor and its resetting for redeployment. A modification of the sea anchor shape is that of a cylindrical form or frusto conical.

BRIEF DESCRIPTION OF THE DRAWINGS

FIG. 9 is a side elevational view of a modified form of sea anchor similar to the one shown in FIG. 7;

FIG. 10 is a side elevational view of a modified form of sea anchor and attachment for a disabling line;

FIG. 11 is a perspective view of the modified form of the invention shown in FIG. 10;

DETAILED DESCRIPTION

Figure 1:
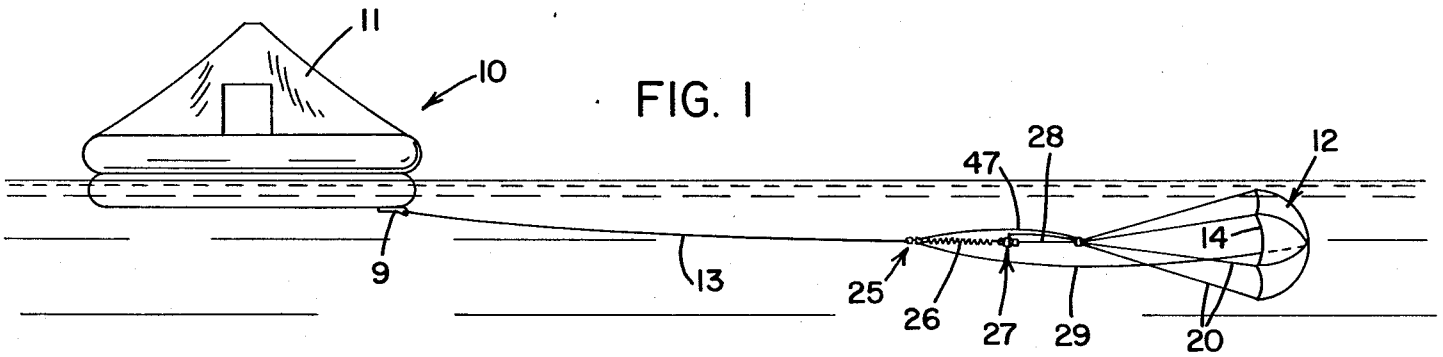
FIG. 1 is general arrangement side elevational view of inflatable raft or vessel attached via a mooring line to a deployed sea anchor in water.

Referring to the drawings wherein like reference numeral designate like or corresponding parts throughout the several views, there is shown in FIG. 1 an inflatable raft or vessel 10. Raft 10 is shown as having a canopy 11 and is secured to a sea anchor 12 by a sea line, mooring line or tow lire 13. Such tow line 13 is secured via a patch 9 to the raft in a manner old and well known in the art.

Figure 2:
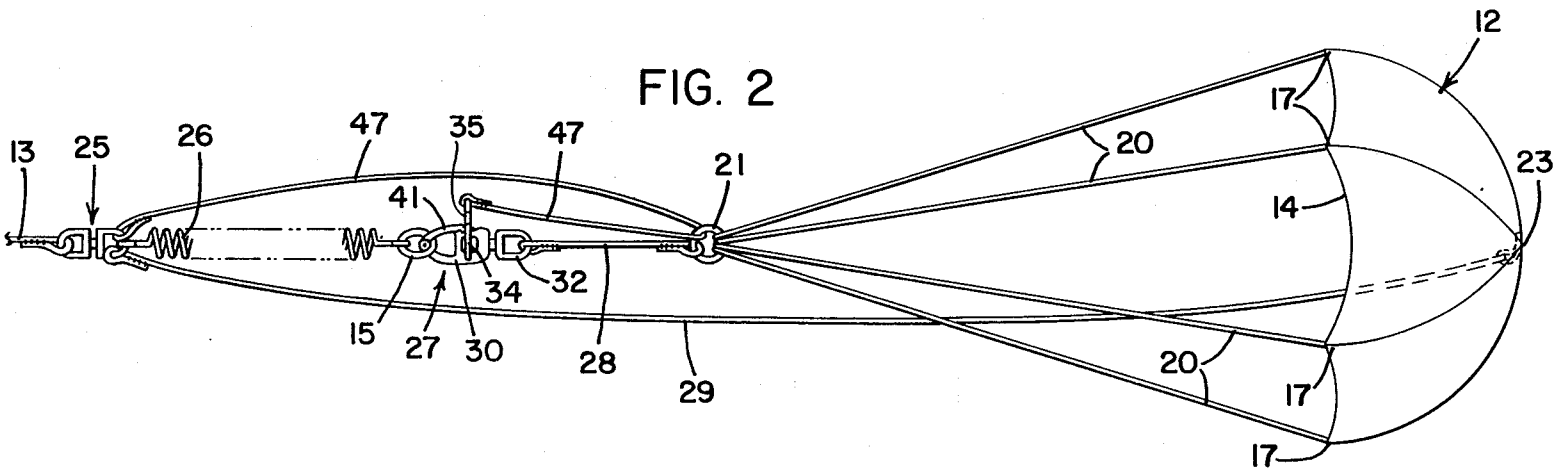
FIG. 2 is a side elevational view of a deployed sea anchor shown attached to a resettable or releasable shackle which in turn is connected via a spring to a mooring line.

Sea anchor 12 is made from a flexible fabric or suitable sheet material that has a peripheral edge 14 which has a plurality of spaced points (designated by numerals 17) that are connected via flexible lines 20 to a sea anchor attachment ring or ring 21. Such lines 20 are fastened to the spaced points 17 which may be grommets in the flexible material of the sea anchor in a manner old and well known in the art. Lines 20 in turn may be ropes, cords, or webbing material of a known construction. As seen in FIG. 2, when the sea anchor is deployed and the respective lines 20 are taut, the sea anchor assumes a shape similar to a parachute, chute or a saucer shaped device. Such chute or saucer shaped flexible material is concave in shape thereby presenting an apex or center 23 for a purpose to be described.

The exact shape of the sea anchor as deployed and shown in FIGS. 1 and 2 is of a general shape and such shape can vary with the object being to assume a concave or cone shape to provide a retarding force as pulled in the water similar to the parachute slowing the descent of a parachutist descending through the air as from an aircraft.

As seen in FIG. 1, the tow line 13 has one end connected to the patch 9 and the other end connected to a swivel 25. Swivel 25 consists essentially of two D-rings with a rotatable connection therebetween. Swivel 25 is connected to one end of a tension spring 26, whose other end in turn is connected to a resettable shackle 27 via a ring 15. Resettable shackle 27 in its normal condition as shown in FIG. 2 is connected via a flexible line or sea anchor connector 28 which in turn is connected to the sea anchor attachment ring or ring 21. The spring 26, ring 15 and the resettable shackle 27 operate as a releasable connecting means between the swivel 25 and the sea anchor 12 in a manner as to be described.

Under the described conditions of attachment of the sea anchor 12 to the raft 10, spring 26 provides a limited giving to the loads improved on the sea anchor. A disabling line 29 has one end connected to the center or apex 23 of the sea anchor 12 and has its other end connected to the swivel 25. The length of the disabling line 29 is of much greater length than the taut condition of spring 26, sea anchor connector 28 and the plural lines 20 providing a normally slack condition to such line 29.

Resettable shackle 27, which operates as a latch means is normally in a latched condition, however as to be described is capable of being unlatched or released to thereby invert the sea anchor 12 whereby the sea anchor 12 is only connected to the raft via the disabling line 29, which then becomes taut and maintains the sea anchor in its inverted and collapsed condition.

Figure 5:
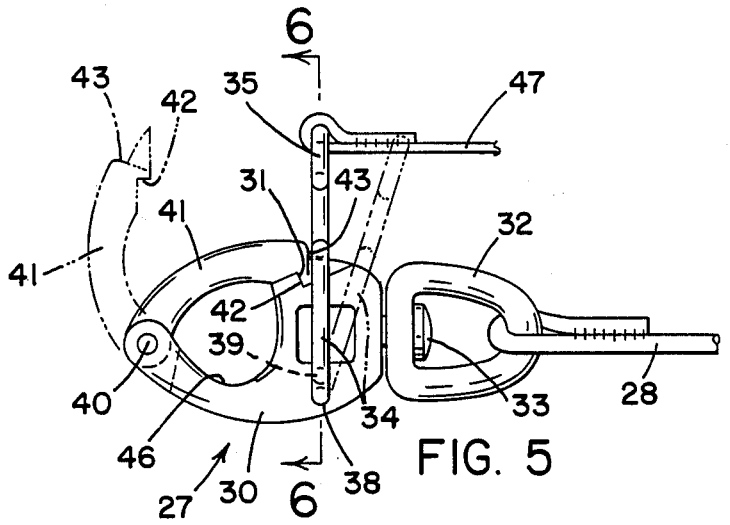
FIG. 5 is an enlarged side elevational view of the resettable shackle.

Shackle 27 (as seen in FIG. 5) has a C-shaped member or base 30 whose one end has a stepped recess 31 that operates as a hook for latching in a manner to be described. Such one end of C shaped member 30 is connected to a swivel ring 32 via a pin or connector 33 which permits relative rotation therebetween.

An oblong shaped latch or lock release member 34 with a vertically extending eye hook 35 (as viewed in FIGS. 5 and 6) is pivotally mounted on one end of such C-shaped member 30. The pivotal connection is shown as a pair of horizontally extending shafts 38 and 39 (as viewed in FIG. 6) which act as a spring to keep 34 in the locked position.

Figure 6:
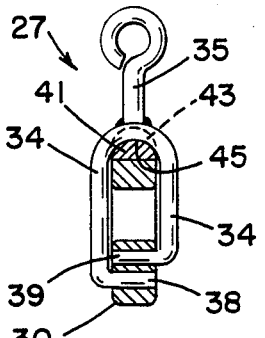
FIG. 6 is a cross sectional view of the resettable sea anchor taken on line 5—5 of FIG. 5.

The other end of C-shaped member 30 is bifurcated and pivotally receives as at 40 the one end of a curved locking link 41 that has its other end notched as at 42 to lock or latch onto stepped recess 31. The exterior portion of such other end of locking link 41 is arcuately recessed as at 43 such that upon pivoting of lock release member 34 thereon, the interior arcuate portion 45 as indicated in FIG. 6 will secure and frictional retain the shackle 27 in its locked position.

Figure 3:
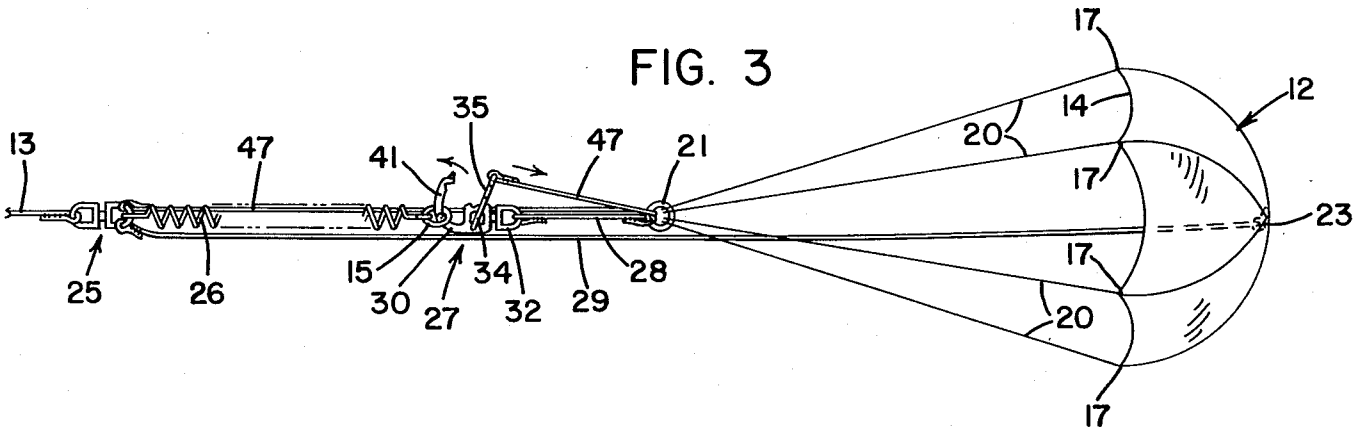
FIG. 3 is a side elevational view of the sea anchor in the process of being disabled by the resettable shackle.
Figure 4:
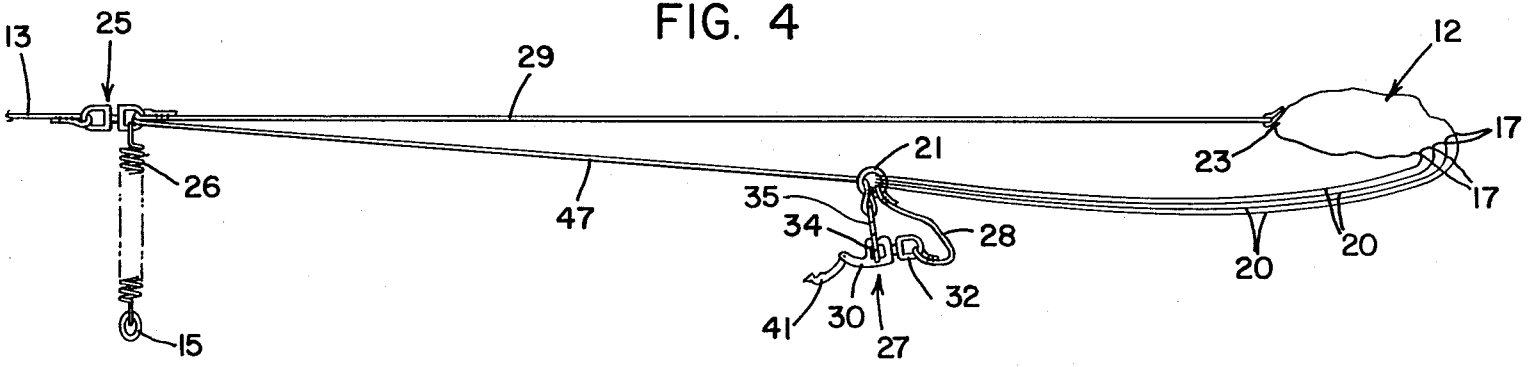
FIG. 4 is a side elevational view of the sea anchor fully disabled with the mooring line connected to the center or central apex of the sea anchor.

A loop 46 as formed by the C-shaped member 30 and the curved locking link 41 receives ring 15 as seen in FIGS. 1, 2 and 3. FIG. 5 as described does not show the ring 15 being held by the releasable or resettable shackle 27 but on setting up the sea anchor for use the ring 15 is slipped onto the shackle 27. The ring 15 is thus connected to shackle 27 via spring 26 which in turn is connected to a swivel 25 and thence via tow line 13 to the vessel or raft 10. As seen in FIGS. 2 and 5, a shackle release line 47 has one end secured to the eye of hook 35 of lock release member 34 and thence passes through the sea anchor attachment ring 21 for connecting the other end to one of the D-rings of swivel 25. Shackle release line 47 is greater in length than the combined distance between the swivel 25 and sea anchor ring 21 combined with the distance from sea anchor ring 21 to resettable shackle 27 to provide sufficient slack in line 47 so that the spring 26, shackle 27 and sea anchor connector 28 maintains a taut condition when the sea anchor 12 is deployed. As the forces are exerted on the sea anchor in a direction away from the raft, spring 26 provided the necessary resiliency to maintain a taut condition; however, as the load increases to a specified load, spring 26 will be in a substantially stretched condition. At this instance shackle release line 47 will also be in a taut condition and any further increase in load on spring 26 will cause the resettable shackle 27 to open as depicted by FIG. 3 whereby lock release member 34 will be moved to the position shown in phantom lines in FIG. 5 since the release line 47 pulls the lock release member 34 rightwardly as viewed in FIG. 5. The ring 15 as depicted by FIG. 3 will continue to exert a separating force by the action of spring 26 being still connected to the tow line 13 until ring 15 separates from shackle 27 to the position shown in FIG. 4. Under this condition, sea anchor 12 is connected to the raft 10 only by the disabling line 29, swivel 25 and tow line 13. It will be observed that the sea anchor under these conditions is inverted or disabled with sufficient slack existing in the snap release line 47 and lines 20. Such condition of unlocking or releasing the resettable shackle 27 transfers the load from the sea anchor attachment ring 21 to the center 23 of the sea anchor 12. The load exerted on the sea anchor 12 in such collapsed or inverted condition will be materially reduced with no possible chance of damaging the raft.

Figure 12:
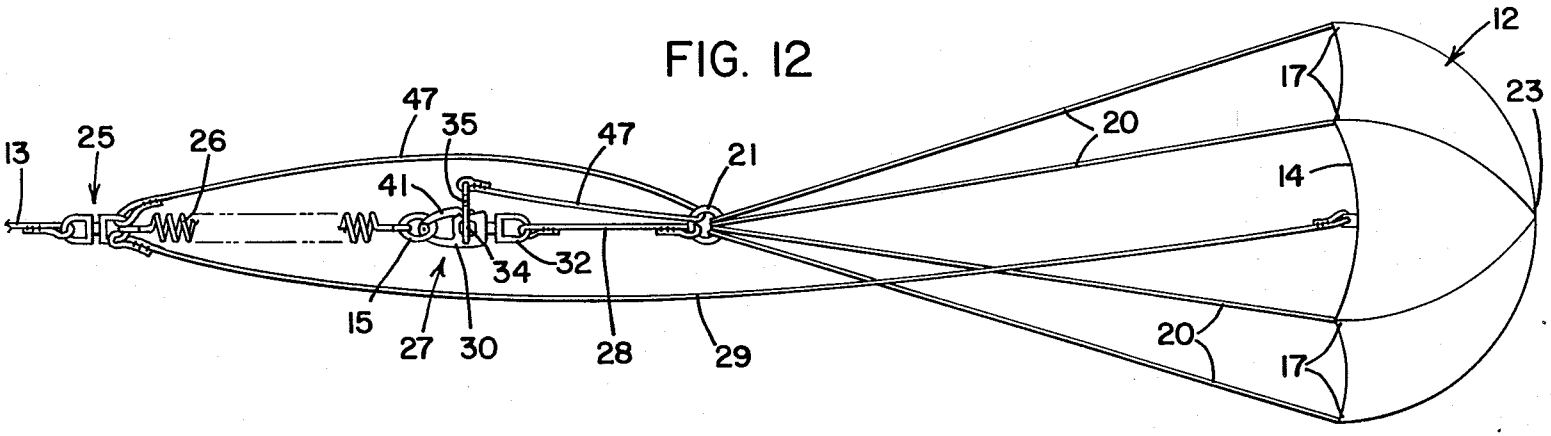
FIG. 12 is a side elevational view of a modified form of a deployed sea anchor similar to that shown in FIGS. 1 and 2 in which the disabling line is connected to the periphery of the deployed sea anchor.

As the severe sea conditions subside, the sea anchor can be retrieved by pulling on tow line 13 and reeling it in until the resettable shackle 27 can be reset with ring 15 inserted into the loop 46 and then pivot locking link 41 until notched end 42 snaps onto stepped recess 31 and such position is retained by the further pivoting of lock release member 34 until its arcuate portion 45 frictionally engages the arcuately recessed portion 43. The sea anchor 12 can then be redeployed. A modification of the above described embodiment is shown in FIG. 12 wherein like reference numerals designate like parts as in the first described embodiment. The only difference is that the disabling line 29 is connected to the periphery of the flexible fabric forming the chute of the sea anchor.

Figure 7:
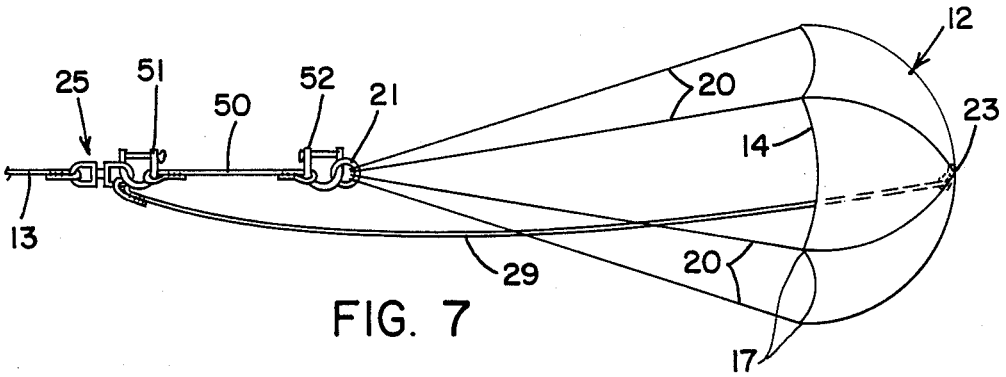
FIG. 7 is a side elevational view of a modified form of releasable sea anchor.
Figure 8:
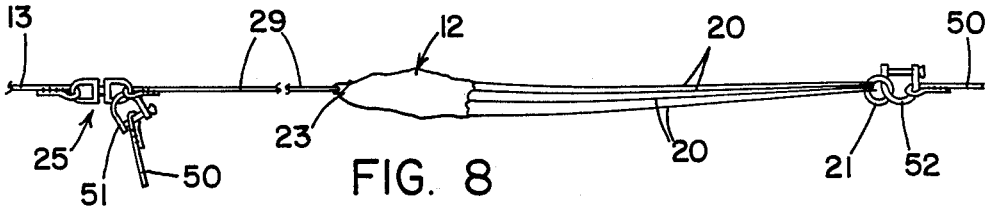
FIG. 8 is a side elevational view of the modified form of the releasable sea anchor of FIG. 7 fully disabled.

A modification of the above described embodiment is shown in FIGS. 7 and 8 wherein like reference numerals will designate like parts as in the first described embodiment. FIG. 7 discloses the tow line 13 which interconnects the raft to the swivel 25 and the sa anchor 12 connected via plural lines 20 to the sea anchor attachment ring 21. Also, as in the first embodiment the center 23 of the sea anchor 12 is connected by a disabling line 29 to one of the D-rings of swivel 25.

Interconnecting the sea anchor attachment ring 21 and the swivel 25 is a release link or release line 50. Line 50 has its respective ends formed into loops for securing spaced D-shackles 51 and 52. Release link 50 replaces the resettable shackle 27, snap release line 47, sea anchor connector 28 and spring 26 in the first embodiment and has the property of breaking when a specified load or force is reached such that the sea anchors will collapse and invert as in the first described embodiment as depicted by FIG. 8. In this condition tow line 13 is connected to swivel 25 and via disabling line 29 directly to the apex or center of the sea anchor with D-shackle 51 and part of release link 50 dangling from swivel 25 while D-shackle 52 attached to ring 21 and trailing the sea anchor 12. In this instance the sea anchor can be redeployed after the release link 50 is replaced. The disabling line 29 must have sufficient slack that it does not come into operation until the release link 50 breaks or fractures after which it comes into operation as described in the first embodiment.

A further modification of the above described invention is shown in FIG. 9 wherein like reference numeral designate like parts as those described in FIGS. 1 and 7. FIG. 9 discloses a similar chute or saucer shaped sea anchor 12 connected by a plurality of lines 20 to the sea anchor attachment ring or ring 21.

As in the embodiment described in FIG. 7, the sea anchor attachment ring 21 and swivel 25 are interconnected by the release link or release line 50 which when subjected to a specified load or force breaks. Such line or link 50 has its respective ends formed into loops for securing such ends to the spaced D-shackles 51 and 52. The disabling line 29 in this embodiment has one end connected to swivel 25 and its other end connected to a patch 60 secured to the outer surface of chute 12 closely adjacent to the peripheral edge 14. Patch 60 may be secured along such peripheral edge or anywhere on the surface of such chute so long as the disabling line 29 has slack therein such that the disabling line 29 does not come into operation until the release link 50 breaks or fractures as described in the other embodiments.

Figure 13:
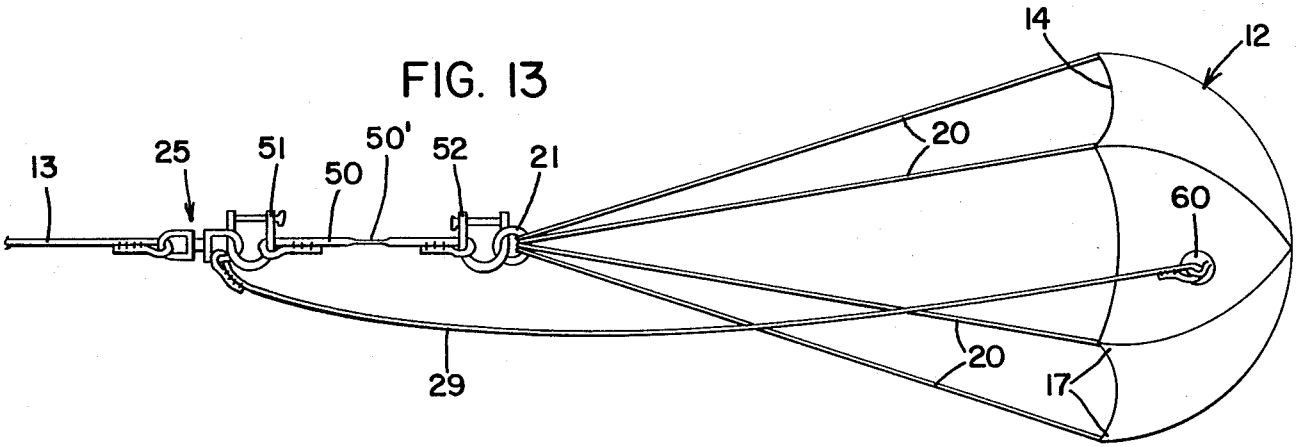
FIG. 13 is a side elevational view of a modified form of sea anchor similar to the one shown in FIG. 9 wherein line or link 50 has a breakable reduced portion.

A further modification of the above described invention is shown in FIG. 13 wherein like reference numerals designate like parts as those described in FIG. 9. FIG. 13 discloses the release link 50 as having a reduced mid-section 50' to facilitate breakage thereof. Although these embodiment has been described as connected to the breakable link or release link 50, it is understood that this type of sea anchor 12 and its disabling line 29 can be used in the first described embodiment wherein the disabling line has one end connected to the swivel 25 as shown in FIG. 2 and has its other end connected to the patch 60 as described immediately above and the disabling means is the same as in FIG. 2 including spring 26, release line 47, and sea anchor connector 28, utilizing the shackle 27 as shown in FIG. 6.

A further modification of the invention is shown in FIGS. 10 and 11 wherein the reference numerals designate like or corresponding parts similar or identical as those described in FIGS. 1, 7 or 9 above. There is shown in FIGS. 10 and 11 a tubular shaped or frusto conical shaped sea anchor 62 made from a suitable fabric or flexible material as sea anchor 12. The forwardly disposed circumferential peripheral 63 has a plurality of spaced points that are connected via flexible lines 20 to the sea anchor attachment ring or ring 21.

As in the embodiment described in FIGS. 7 or 9, such sea anchor attachment ring 21 is connected via release link or release line 50 to swivel 25. Such frusto conical shaped sea anchor 62 has a rearwardly disposed circumferentially extending periphery 65. Stiffener cables may be sewn into the respective peripheries 65 and 63 or just into the forwardly disposed periphery 63 to facilitate the water flow through such sea anchor as it is being deployed and held by the lines 20 and the raft. As the sea anchor is being stabilized by the raft, water passing through the frusto conical anchor provides sufficient resistance or drag to stabilize the raft and prevent undue drifting. The disabling line 29 has one end connected to the swivel 25 and the other end connected to a patch 66 on the body portion of sea anchor 62. Such patch 66 may be located on either the forwardly disposed periphery 63, the rearwardly disposed periphery 65 or in between on the body portion of the fabric material of the sea anchor with sufficient slack in the disabling line 29 to render such line 29 non-functional until the release link or release line 50 renders it functional wherein it operates to disable the sea anchor.

Figure 14:
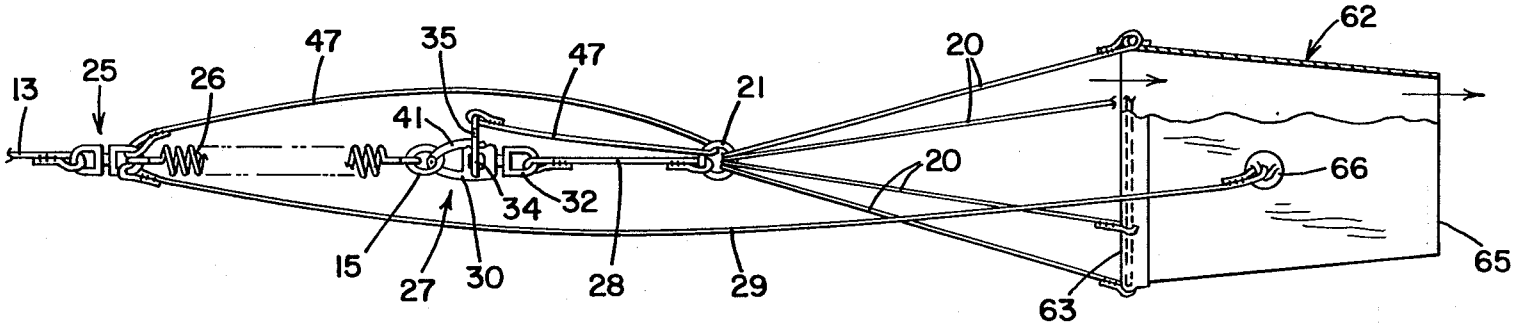
FIG. 14 is a side elevational view of a modified form of sea anchor having a ressetable or releasable shackle similar to that shown in FIG. 2.

Although this embodiment has been described as connected to the breakable link or release link 50, it is understood that this type of sea anchor 62 and its disabling line 29 can be used in the first described embodiment wherein the disabling line has one end connected to the swivel 25 as shown in FIG. 2 and has its other end connected to the patch 66 as described immediately above and the disabling means is the same as described with respect to FIG. 2 including spring 26, release line 47, and sea anchor connector 28, utilizing the shackle 27 as shown in FIG. 6 and described hereinabove. Such modification is shown in FIG. 14 wherein like reference numerals designate like parts as those described in FIGS. 10 and 2.

It will be apparent that, although a specific embodiment and certain modifications of the invention have been described in detail, the invention is not limited to the specifically illustrated and described constructions since variations may be made without departing from the principles of the invention.

I claim:

1. A recoverable sea anchor for a vessel comprising a flexible sheet material with a periphery and a center;

a ring; a plurality of lines interconnecting said ring with a plurality of spaced points around said periphery to define a concave chute with said periphery displaced from said center by a predetermined distance upon deployment as a chute, a swivel for connection to a mooring line for attachment to a vessel;

releasable connecting means for connecting said ring to said swivel, said releasable connecting means actuated in response to a predetermined load on said chute to release said connection between said swivel and said ring;

a disabling line in a slack inoperative condition interconnecting said swivel and said chute and operative upon actuating of said releasable connection in response to said predetermined load being reached to render said chute inoperative and collapse said chute.

2. A recoverable sea anchor as set forth in claim 1 wherein said disabling line is connected to said periphery of said chute.

3. A recoverable sea anchor as set forth in claim 1 wherein said disabling line is connected to said chute at a location between said center and said periphery of said chute.

4. A recoverable sea anchor as set forth in claim 1 wherein said disabling line is connected to said center of said chute.

5. A recoverable sea anchor as set forth in claim 4 wherein the length of said disabling line is greater than the distance from said swivel to said center of said chute in a deployed condition.

6. A recoverable sea anchor as set forth in claim 5 wherein said releasably connecting means includes latch means moveable between a closed and an open position, said latch means in said closed position operative to receive and retain an annular member thereon, said annular member connected to said swivel and detachable from said latch means in said open condition.

7. A recoverable sea anchor as set forth in claim 6 wherein a spring is interconnected between said annular member and said swivel to facilitate a limited axial movement therebetween.

8. A recoverable sea anchor as set forth in claim 7 wherein said releasably connecting means is connected to said ring by a sea anchor connector; said latch means includes a release line connected via said ring to said swivel; and said release line having a slack therein to permit limited axial movement of said spring prior to release of said annular member from said latch means.

9. A recoverable sea anchor for a vessel comprising a flexible sheet material with a periphery and a center, a plurality of lines have their one ends connected to spaced points along said periphery, the other ends of said plural lines connected to a ring, a release link interconnecting said ring to a swivel, a mooring line having one end connected to said swivel and having the other end connectable to such vessel to provide the deployment of said sea anchor from such vessel to permit said sea anchor to assume a concave shape, a longitudinally extending line interconnecting said center of said sea anchor with said swivel, said release link having a predetermined rupture strength that tears upon sufficient predetermined load exerted between said concave shaped flexible sheet material and said swivel, and said longitudinally extending line being of sufficient length to provide slack in its line when said flexible sheet material is deployed into its concave shape.

10. A recoverable sea anchor for a vessel comprising a flexible sheet material with a periphery and a center; a ring; a plurality of flexible lines interconnecting said ring with a plurality of spaced points on said periphery to facilitate a concave shape to said sheet material upon deployment;

a swivel for connection to a mooring line for attachment to a vessel, a disabling line in a slack condition interconnecting said swivel to said sheet material; a link having one end connected to said ring and having the other end connected to a swivel ring; said swivel ring connected to a resettable shackle; said shackle being connected directly to said swivel for maintaining a load on said shackle from said swivel to said periphery on deployment of said flexible sheet material into a concave shape; and said shackle being operative to disengage from said swivel upon being subjected to a predetermined load.

11. A recoverable sea anchor as set forth in claim 10 wherein said disabling line is connected to said center on said flexible sheet material.

12. A recoverable sea anchor as set forth in claim 10 wherein said shackle has a C-shaped base, a locking link pivotably mounted on said base, a lock release member pivotally mounted on said base for engagement with said locking link to retain said locking link in engagement with said base to define a locked position, said lock release member connected to said swivel in a slack condition.

13. A recoverable sea anchor for a vessel comprising a flexible sheet material with a periphery and a center, a ring, a plurality of flexible lines interconnecting said ring to a plurality of spaced points on said periphery to facilitate a concave shape upon deployment thereof, a swivel, a breakable link having one end connected to said ring and having the other end connected to said swivel, a mooring line having one end connected to said swivel ard adapted to have the other end connected to a vessel for deployment of such sea anchor therefrom, the stretched length of said link and the length of said deployed concave flexible sheet defines a predetermined length from said center to said swivel, and a disabling line longer than said predetermined length interconnected between said flexible sheet material and said swivel, and said link breakable under a preset load.

14. A recoverable sea anchor as set forth in claim 13 wherein said link has a reduced mid section to make said link breakable at said reduced section.

15. A recoverable sea anchor as set forth in claim 14 wherein said disabling line is connected to said center of said sheet material.

16. A recoverable sea anchor for a vessel comprising a flexible sheet material with at least one periphery;

a ring; a plurality of lines interconnecting said ring with a plurality of spaced points around said periphery to deploy said sea anchor to provide a drag on said lines; a swivel; a mooring line having one end attached to a vessel; said mooring line having its other end attached to said swivel;

releasable connecting means for connecting said ring to said swivel;

said releasable connecting means actuated in response to a predetermined load on said sea anchor to release said connection between said swivel and said ring;

a disabling line in a slack inoperative condition interconnecting said swivel and said sea anchor and operative upon actuating of said releasable connection in response to said predetermined load being reached to render said sea anchor inoperative and collapse said sea anchor.

17. A recoverable sea anchor as set forth in claim 16 wherein said sea anchor is frusto conical in shape; said frusto conical shape has a forwardly disposed periphery and a rearwardly disposed periphery; and said forwardly disposed periphery is connected to said plural lines.

18. A recoverable sea anchor as set forth in claim 17 wherein said releasably connecting means includes latch means moveable between a closed and an open position, said latch means in said closed position operative to receive and retain an annular member thereon, said annular member connected to said swivel and detachable from said latch means in said open condition.

19. A recoverable sea anchor as set forth in claim 18 wherein a spring is interconnected between said annular member and said swivel to facilitate a limited axial movement therebetween.

20. A recoverable sea anchor as set forth in claim 19 wherein said releasably connecting means is connected to said ring by a sea anchor connector; said latch means includes a release line connected via said ring to said swivel; and said release line having a slack therein to permit 1imited axia1 movement of said spring prior to release of said annular member from said latch means.

* * * * *